United States Patent [19]

Friihauf

[11] 4,129,508

[45] Dec. 12, 1978

[54] DEMULSIFIER ADDITIVE COMPOSITIONS FOR LUBRICANTS AND FUELS AND CONCENTRATES CONTAINING THE SAME

[75] Inventor: Edward J. Friihauf, Mentor, Ohio

[73] Assignee: The Lubrizol Corporation, Wickliffe, Ohio

[21] Appl. No.: 899,037

[22] Filed: Apr. 24, 1978

Related U.S. Application Data

[63] Continuation-in-part of Ser. No. 841,617, Oct. 13, 1977, abandoned.

[51] Int. Cl.[2] ..... C10M 1/40; C10M 3/34; C09K 50/00; C10L 1/32

[52] U.S. Cl. ..... 252/33; 44/51; 252/51.5 R

[58] Field of Search ..... 252/33, 51.5 R, 75; 44/51

[56] References Cited

U.S. PATENT DOCUMENTS

| | | | |
|---|---|---|---|
| 3,045,042 | 7/1962 | Staker | 260/485 |
| 3,240,575 | 3/1966 | Miller et al. | 44/66 |
| 3,381,022 | 4/1968 | LeSuer | 260/404.8 |
| 3,806,456 | 4/1974 | Vogel | 252/51.5 A |
| 3,909,425 | 9/1975 | Crawford et al. | 252/33 |
| 3,939,088 | 2/1976 | Goldschmidt et al. | 252/56 D |
| 3,957,855 | 5/1976 | Miller | 260/482 R |
| 4,031,023 | 6/1977 | Musser et al. | 252/75 |

*Primary Examiner*—Irving Vaughn
*Attorney, Agent, or Firm*—James W. Adams, Jr.; S. I. Khayat

[57] ABSTRACT

Lubricant and fuel compositions characterized by improved demulsifying properties are disclosed, which properties are contributed substantially by an additive comprising a mixture of:

(A) One or more reaction products of a hydrocarbon-substituted succinic acid or anhydride with one or more polyalkylene glycols or monoethers thereof,
(B) One or more organic basic metal salts, and
(C) one or more alkoxylated amines.

33 Claims, No Drawings

DEMULSIFIER ADDITIVE COMPOSITIONS FOR LUBRICANTS AND FUELS AND CONCENTRATES CONTAINING THE SAME

CROSS-REFERENCE TO RELATED APPLICATIONS

This application is a continuation-in-part of my copending application Ser. No. 841,617, filed Oct. 13, 1977 abandoned.

The present invention relates to lubricant and fuel compositions having improved demulsifying properties. In particular, the invention is concerned with a demulsifier additive for use in lubricants such as power transmitting fluids, crankcase, gear, marine diesel, and fuels such as gasoline and diesel coming into contact with water and moisture, especially during storage and/or handling and reclaiming operations.

It is well known that water is an undesirable contaminant in fuels, and lubricants. For, not only does water reduce the effectiveness of the fuel or lubricant, it tends to form deleterious by-products, particularly in relation to the engine or parts in contact with or utilizing the lubricant. For instance, water present in a crankcase lubricant is responsible for the formation of objectionable mayonnaise-like sludge which in turn promotes the formation of hard-to remove deposits from engine parts. Presumably the formation of the sludge is preceded by the water forming an emulsion with the lubricant oil. While water should be separable from an oil or lubricant due to immiscibility, often the additives in many lubricants have water solubility sufficient to form emulsions which are difficult to remove. Thus, it is important to minimize the presence of water in lubricants to thereby reduce or eliminate the formation of such emulsions.

Naturally, lubricants having minimum contact with water would not present the serious problems of water-/oil emulsions. However, it is difficult to eliminate contact with water, particularly during storage and/or handling. One particular procedure which gives rise to water contamination involves factory-fill transmission fluids. During assembly and testing of automotive drive-train parts, the transmissions, especially automatic transmissions, are filled with the proper water-free transmission fluid for testing and inspecting under running and operating conditions. After such testing, the fluid is allowed to drain into exposed troughs or collecting stations leading to a main collecting tank. The drained oil is not protected from the immediate environment and often contains, among other things, a considerable amount of water. For efficiency and economy the collected oil should be re-used with minimal processing including filtering and centrifugation. To do so an effective demulsifier must be added to the lubricant.

In the prior art many demulsifiers have been suggested and used. Mainly these demulsifiers have comprised a polyoxyalkylene glycol or a polyoxypolyamine. These glycols and polyamines have not been entirely satisfactory because of their limited use and inability to function except in specific lubricants or fuels. Thus, there has been the need to "custom-make" specific demulsifiers, which is costly.

The demulsifiers of the present invention have overcome many such disadvantages. They have shown effectiveness in a variety of lubricants and fuels by substantially reducing the formation of emulsions in such lubricants and fuels. They have been of particular benefit to water-contaminated factory-fill automatic transmission fluids referred to above.

Thus it is a primary object of the present invention to provide fuel and lubricant compositions comprising one or more effective demulsifier additives in accordance with the invention.

Another object is to provide concentrates containing such demulsifier additives to the extent that each of said concentrates is capable of providing demulsifying properties to the fuel or lubricant into which it is incorporated.

Another object of the invention is to provide a method of making the demulsifier additives, and concentrates, fuels and lubricants containing said additives.

Other objects and advantages of the present invention will be apparent to those skilled in the art from consideration of the following description.

Briefly, the present invention is directed to fuel and lubricant compositions having a major proportion of a lubricating oil or normally liquid fuel and a minor proportion of at least one demulsifier additive comprising (A) one or more reaction products of a hydrocarbon-substituted succinic acid or anhydride with one or more polyalkylene gylcols or monoethers thereof, (B) one or more organic basic metals salts, and (C) one or more alkoxylated amines.

Component (A) is an ester wherein the acid comprises a hydrocarbon-substituted succinic acid or anhydride in which the hydrocarbon substituent is generally a substantially saturated aliphatic group of 4 to about 50 carbon atoms in the chain, preferably from 6 to about 30 carbon atoms, and most preferably, from 8 to about 16 carbon atoms. The hydrocarbon substituent may contain polar groups provided, however, that such groups are not present in proportions sufficiently large to alter significantly the hydrocarbon character of the substituent. The polar groups are exemplified by the chloro, bromo, keto, ether, aldehyde, nitro, etc. The upper limit with respect to the portion of such polar groups in the substituent is approximately 10% based on the weight of the hydrocarbon portion of the substituent.

The sources of the succinic acid or anhydride hydrocarbon substituent include a variety of monomers, oligomers, prepolymers, and even polymers. Oligomers can be combination of two or more monomers; prepolymers refer to polymeric species capable of undergoing the addition reaction with the maleic acid or anhydride. Monomers comprise any $\alpha$-monoolefin of 4 to 50 carbon atoms. $\alpha$-Monoolefins such as 1-butene, isobutene, 1-hexene, 1-octene, 2-methyl-1-heptene, 3-cyclohexyl-1-butene, and 2-methyl-5-propyl-1-hexene are quite useful. Preferably dimers, trimers, or tetramers of ethylene or propylene are used to an especial advantage. Polymers of medial olefins, i.e., olefins in which the olefinic linkage is not at the terminal position, likewise are useful. They are illustrated by 2-butene, 3-pentene, and 4-octene. It is preferred that polymers derived from 3 to 6 carbon atom monoolefins are used, such as polypropylene or polybutene.

The hydrocarbon-substituted succinic acid or anhydride is reacted with one or more polyalkylene glycol to form the ester. The polyalkylene glycols, or their monoethers, contemplated by the present invention are illustrated by, for example, several polyethylene glycols having molecular weights in the range of about 200 to about 1500. Specifically, polyethylene glycol of 200, 300 and 600 molecular weights are especially useful. Similarly, polypropylene glycols having molecular weights in the same range of about 200 to 1500 are likewise useful. These polyalkylene glycols and their monoethers which are commercially available products (marketed by Union Carbide Corp., New York, N.Y. as Carbowax) can be obtained by reacting the glycol with ethylene or propylene oxide. Methods of preparing such glycols are known to those skilled in the art.

As to the monoethers of said polyalkylene glycols, they are illustrated by ethers such as monomethyl ether of polyethylene glycol, monoethylether of polyethylene glycol, monopropyl- and monobutyl ethers of polyethylene glycols. Generally, monoalkyl ethers wherein the alkyl group contains from 1 to about 12 carbon atoms are contemplated herein with the proviso that the average molecular weight does not exceed about 1500.

The esterification reaction is conducted under conventional esterification conditions whereby the hydrocarbon-substituted acid or anhydride is reacted with the glycol at temperatures above about 100° C., preferably between about 110° to about 150° C. Higher temperatures of about 150°-300° C. can be used, if desired. Of course, the extent of esterification can be controlled to produce substantially neutral esters, acidic esters, or mixtures of these. It has been found that the acidic esters are generally most effective and they are thus much preferred. Therefore, in conducting the esterification the reactants are introduced into the reactor at ratios designed to favor the production of the acid ester. For clarity, the acid ester is defined as the product formed from the reaction of a dibasic acid (or anhydride) with a polyol in such ratios that the carboxylic acid moieties are never completely esterified. Thus when one mole of a dibasic acid is reacted with one mole of alcohol, the half ester or acid ester is formed. Similarly, if 2 moles of a dibasic acid (or anhydride) are reacted with a diol the half or acid ester is formed. The latter can be illustrated by the following representative reaction.

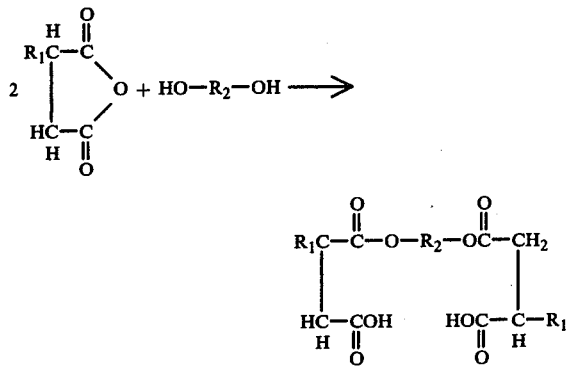

wherein $R_1$ (5-50C) is the hydrocarbon substituent of the succinic anhydride and $R_2$ represents the polyalkylene group of the glycol. In the event the mono-ether such as methoxy polyalkylene glycol is used then to prepare the acid ester the ratio becomes one mole of acid to one mole of the monoether as the latter has one hydroxyl moiety available for reaction.

Referring to component (B) of the demulsifier additive it describes the well known class of basic metal organic salts in which the metal is present in a stoichiometrically greater amount than necessary to produce the neutral salt. These salts are often referred to as "basic salts", "overbased salts", "super-based salts" and "hyperbased salts".

Such basic metal salts are known in the art. Those which are contemplated herein include salts derived from oil-soluble sulfonic acids, oil-soluble carboxylic acids, oil-soluble phosphonic acids, oil-soluble phenolic acids and mixtures thereof, such as are described in U.S. Pat. Nos. 2,501,731; 2,616,904; 2,616,905; 2,616,906; 2,616,911; 2,616,924; 2,696,025; 2,617,049; 2,777,874; 3,207,325; 3,256,186; 3,282,835; 3,384,585; 3,373,108; 3,365,396; 3,342,73; 3,320,162; 3,312,618; and 3,318,809. For the sake of brevity, the disclosures of the above patents are hereby incorporated in the present specification for their description regarding the preparation and identification of such compounds.

As an example of a particularly convenient process for the preparation of the basic salts used, an oil-soluble sulfonic acid, such as a synthetically prepared didodecylbenzene sulfonic acid, is mixed with an excess of lime (e.g., 10 equivalents per equivalent of the acid) and a promoter such as methanol, heptylphenol, or mixture thereof, and a solvent such as mineral oil, at 50° C. -150° C. and the process mass is then carbonated until a homogeneous mass is obtained. Basic salts derived from sulfonic acids, carboxylic acids, and mixtures thereof are obtainable by processes such as are described in U.S. Pat. No. 3,312,618. Another example is the preparation of a magnesium sulfonate basic salt by carbonating a mixture of a sulfonic acid or normal magnesium salt thereof, an excess of magnesium oxide, water, and preferably also an alcohol promoter such as methanol.

The carboxylic acids useful for preparing sulfonate-carboxylate basic salts, and carboxylate basic salts, i.e., those obtainable from processes such as the above wherein a mixture of sulfonic acid and carboxylic acid or a carboxylic acid alone is used in lieu of the sulfonic acid, are oil-soluble acids and include primarily fatty acids which have at least about 12 aliphatic carbon atoms and not more than about 24 aliphatic carbon atoms. Examples of these acids include: palmitic, stearic, myristic, oleic, linoleic, dodecanoic, behenic, etc. Cyclic carboxylic acids may also be employed. These include aromatic and cyclo-aliphatic acids. The aromatic acids are those containing a benzenoid structure (i.e., benzene, naphthalene, etc.) and an oil-solubilizing radical or radicals having a total of at least about 15 to 18 carbon atoms, preferably from about 15 to about 200 carbon atoms. Examples of the aromatic acids include: stearyl-benzoic acids, phenyl stearic acid, mono- or polywax-substituted benzoic or naphthoic acids wherein the wax group consists of at least about 18 carbon atoms, cetyl hydroxybenzoic acids, etc. The cycloaliphatic acids contemplated have at least about 12, usually up to about 30 carbon atoms. Examples of such acids are petroleum naphthenic acids, cetyl cyclohexane carboxylic acids, di-lauryl decahydronaphthalene carboxylic acids, di-octyl cyclopentane carboxylic acids, etc. The thiocarboxylic acid analogs of the above acids, wherein one or both of the oxygen atoms of the carboxylic group are replaced by sulfur, are also contemplated. The ratio of the sulfonic acid to the carboxylic acid in sulfonate-carboxylate mixtures is at least 1:1 (on a chemical equivalent basis) and is usually less than 5:1, preferably from 1:1 to 2:1.

In general, basic salts having metal ratios from about 1.1 to about 30 are contemplated for use in the present invention. Those prepared from Mg, Ca, Ba, Li, or Na and having metal ratios ranging from 2 to 20 are preferred.

The alkoxylated amines (Component C) of the present invention which comprise alkylene oxide derivatives of aliphatic amines. These alkoxylated amines are secondary or tertiary amines having one or more groups of the formula $-NR_1R_2$ wherein $R_1$ is $-(O\text{-alkylene})_n-OH$, wherein alkylene is straight or branched chain and contains up to 6 carbon atoms and usually 2 to 4 carbon atoms and n is a number of 1 to about 10, and $R_2$ is selected from hydrogen, an alkyl group of up to about 18 carbon atoms, and $R_1$. Representative alkoxylated amines are the ethoxylated amines which are tertiary amines having one alkyl group and two polyoxyethylene groups attached to the nitrogen:

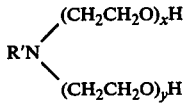

wherein R' represents an alkyl group of up to 18 carbon atoms, x and y are numbers ranging each from 1 to about 8 with the proviso that the sum of x+y equals at least 2 and not greater than about 15. The source of the alkyl group R' is preferably a fatty acid such as coco, oleic, soya, tallow, or stearic fatty acids.

Also contemplated as the alkoxylated amine (Component C) are the ethoxylated amines obtainable by reacting ethylene oxide with a diamine. For example, N-alkyl trimethylene diamine can be reacted with ethylene oxide to produce a compound represented by the following:

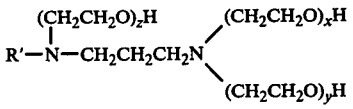

wherein R', x, and y are as above described and z is a number from 1 to 8 with the proviso that the sum of x, y, and z does not exceed about 15.

The alkoxylated amines of the present invention are commercially available products obtainable from various sources. Those marketed under the name ETHOMEEN and ETHODUOMEEN (made by Armak Co., part of Akzona, Inc.) are particularly preferred.

Because of their availability ethylene oxide and propylene oxide represent the most practical alkylene oxide reagent for preparing the above alkoxylated amines. However, butylene oxide, pentene oxide and others can be used, also. For most efficient use ethylene oxide (to make the corresponding ethoxylated amine) is preferred.

In preparing the demulsifier additive of the present invention Components (A), (B) and (C) are mixed physically to make up a substantially homogeneous mixture for incorporation into lubricants or fuels or to make up concentrates for subsequent addition to lubricants or fuels. Preferredly, the demulsifier additive is formed in stages whereby Components (A) and (B) are admixed and heated at about 50°-125° C. for sufficient time, usually up to about 3 hours. Component (C), the alkoxylated amine, then is mixed with the above initial mixture/product of (A) and (B) just prior to preparation of the concentrate or prior to addition to the lubricant. Of course, the three components can be admixed together and heated at about 50°-125° C. for up to about three hours to provide the demulsifier additive. While heating at about 50°-125° C. is not essential, it has been found beneficial in providing optimum demulsifier additives. For best results, Components (A) and (B) are heated at the prescribed temperature range with (C) being admixed subsequently.

In terms of the lubricant composition the demulsifier additive comprises from about 0.05 to about 2.0% by weight of the total weight of the composition. Higher amounts can be added, if desired, but it is believed that amounts greater than 2% are not necessary and can contribute to higher costs. Specifically Component (A) can be from about 0.03 to about 1% by weight of the lubricant. Similarly, Component (B) can be from about 0.01 to about 1% by weight, and Component (C) can be from about 0.001 to about 1% by weight, respectively, of the lubricant.

The fuels to which the demulsifier additives of the invention are added are the normally liquid fuels, such as gasoline, diesel fuels, jet fuels, fuel oils, alcohols, alcohol mixtures, and distillate oils which do not utilize as much demulsifier additive as do lubricants. Thus, for effective demulsification of the fuel, usually about 1 ppm to about 200 ppm (parts per million) of the demulsifier additive is incorporated into the fuel.

The demulsifier additives of the present invention generally are soluble or stably dispersible in the normally liquid lubricant or fuel in which it is intended to function. Lubricant compositions, by and large, contain lubricating oil as a major proportion. Thus, the demulsifier should be at least stably dispersible in such lubricating oils. To function properly the demulsifier need not be oil soluble. For clarity, the term "oil soluble" as used herein does not necessarily mean that all of the compositions in question are miscible or soluble in all proportions in all oils. Rather, it is intended to mean that the demulsifier additive composition herein described in soluble in an oil which is used for lubricating purposes at the concentrations described hereinbefore. Similarly, it is not necessary that such solutions be true solutions in the strict physical or chemical sense. They may be instead microemulsions or colloidal dispersions which, for the purposes of this invention, would exhibit properties sufficiently close to those of true solutions to be for practical purposes interchangeable within the context of this invention. Also, the term "stably dispersible" in the normally liquid media as used herein is intended to mean a demulsifier composition which is capable of being dispersed in a given medium to an extent which allows it to function as a demulsifier. Thus, the demulsifier additives of the present invention can be dispersed stably in a lubricating oil and impart to it the desired demulsifying properties. Such stable dispersion of the demulsifier can be achieved in various conventional ways, such as by physical agitation. Other means of suspending and/or dispersing a minor component in a major liquid component are very well known to those of ordinary skill in the art, that need not be described herein. For example, conventional dispersants and detergents normally present in lubricants promote the solubility and/or stable dispersion of the herein described demulsifier additives.

This invention is exemplified in the following examples. Of course, these examples are not intended as limiting this invention as modification of the examples by ordinary expedient will be readily apparent to those of ordinary skill in the art.

In all examples, unless otherwise stated, all temperatures are in degrees Centigrade; all parts are parts by weight; and all percentages are percentages by weight.

EXAMPLE 1

A mixture of 133 parts (0.5 mole) of a tetrapropenyl substituted succinic anhydride, 375 parts (0.5 mole) of a commercially available methoxy polyoxyethylene glycol (Carbowax 750 obtained from Union Carbide Corp.) having an average formula molecular weight of about 750, and 200 parts of toluene is heated to 100° C. The reaction mixture is held at 100°-120° C. for 8 hours, then stripped at 120° C. under vacuum for one hour. The reaction mixture is filtered to yield the filtrate as the desired acid ester product.

EXAMPLE 2

The procedure for Example 1 is repeated except the methoxy polyoxyethylene glycol (Carbowax 750) having an average formula molecular weight of about 750 is replaced on equimolar basis by one having a formula molecular weight of 350 (Carbowax 350). The filtrate is the desired acid ester product.

EXAMPLE 3

A mixture of 347 parts (1.3 moles) of a tetrapropenyl substituted succinic anhydride and 261 parts (0.65 mole) of a commercially available polyoxyethylene glycol (Carbowax 400) having an average formula molecular weight of about 400 is heated at 120° C. for 6 hours. The product is filtered to yield the filtrate as the desired acid ester product.

EXAMPLE 4

A mixture of 4256 parts (32 equivalents) of a tetrapropenyl substituted succinic anhydride and 2400 parts (16 equivalents) of a commercially available polyoxyethylene glycol (Carbowax 300) having an average formula molecular weight of about 300 is heated at 120° C. for 3 hours. The residue is the desired ester product.

EXAMPLE 5

The procedure for Example 4 is repeated except the polyxoyethylene glycol (Carbowax 300) having a formula molecular weight of about 300 is replaced on an equimolar basis by a polyoxyethylene glycol (Carbowax 200) having a formula molecular weight of 200. The product is the desired ester product.

EXAMPLE 6

The procedure for Example 4 is repeated except the polyoxyethylene glycol (Carbowax 300) having an average formula molecular weight of about 300 is replaced on an equimolar basis by a polyoxyethylene glycol (Carbowax 1000) having an average formula molecular weight of about 1000. A similarly desired ester product is obtained.

EXAMPLE 7

The procedure for Example 3 is repeated except the polyoxyethylene glycol (Carbowax 400) is replaced on an equimolar basis by polyoxypropylene glycol having an average formula molecular weight of about 425. The ester obtained is the desired ester product.

EXAMPLE 8

The procedure for Example 3 is repeated except the polyxoyethylene glycol (Carbowax 400) having an average formula molecular weight of about 400 is replaced on an equimolar basis by a polyoxypropylene glycol having an average formula molecular weight of about 1000.

EXAMPLE 9

A mixture of 466 parts (1 equivalent) of the acid ester prepared in Example 4 and 114 parts of a basic magnesium sulfonate commercially available from Witco Chemical Company, Chicago, Illinois as Hybase M-400 Magnesium Sulfonate is heated at 120°-130° C. for 3 hours. The residue is the desired product.

EXAMPLE 10

A mixture of 6656 parts (16 equivalents) of the acid ester product prepared in Example 4 and 2272 parts (16 equivalents) of a basic magnesium sulfonate commercially sold by Witco Chemical Company as Hybase M-400 Magnesium Sulfonate is heated at 120°-130° C. for 2 hours. The residue is the desired product.

EXAMPLE 11

A mixture of 466 parts (1 equivalent) of the acid ester product prepared in Example 4 and 284 parts (2 equivalents) of a basic magnesium sulfonate commercially available from Witco Chemical Company as Hybase M-400 Magnesium Sulfonate is heated at 120°-130° C. for 3 hours. The residue is the desired product.

EXAMPLE 12

The procedure for Example 9 is repeated except the acid ester product of Example 4 is replaced on an equivalent basis by the acid ester product of Example 1.

EXAMPLE 13

The procedure of Example 11 is repeated except the acid ester product of Example 4 is replaced on an equivalent basis by the acid ester product of Example 5.

EXAMPLE 14

A mixture of 331 parts of mineral oil, 69 parts of heptylphenol, 50 parts of water, 54 parts of a polytbutenyl (Mn = 1000) substituted succinic anhydride, 58 parts of lithium hydroxide monohydrate and 465 parts of an alkyl benzene sulfonic acid having a molecular weight of about 390 is heated at reflux for 1 hour. An additional 150 parts lithium hydroxide monohydrate is added to the reaction mixture, which is then dried at 150° C. At 150°-155° C. the reaction mixture is blown with 210 parts (5 equivalents) of carbon dioxide over a 2-hour period. The reaction mixture is stripped at 155°-160° C. under nitrogen for 1 hour. The reaction mixture is filtered to yield the desired basic lithium sulfonate having 25% lithium sulfate ash.

EXAMPLE 15

A mixture of 416 parts (1 equivalent) of the acid ester product prepared in Example 4 and 261 parts (1 equivalent) of the basic lithium sulfonate prepared in Example 14 is heated at 100° C. for 3 hours. The residue is the desired product.

EXAMPLE 16

The procedure for Example 15 is repeated except the acid ester product prepared in Example 4 is replaced on an equivalent basis by the acid ester product of Example 3.

EXAMPLE 16A

A mixture is prepared from 200 parts each of polyethylene glycol (200), polyethylene glycol (300) and polyethylene glycol (400) and 1000 parts of tetrapropenyl substituted succinic anhydride, said mixture is heated at 120° C. for about 3 hours. The residue is the desired mixed acid ester.

EXAMPLE 16B

To 400 parts of the mixed acid ester prepared in Example 16A is added 75 parts of basic magnesium sulfonate (Hybase M-400) and 25 parts of the basic lithium sulfate prepared in Example 14. The admixture is heated at 100° C. for about 3 hours to yield the desired product.

EXAMPLE 17

A mixture is prepared by the slow addition of 187 parts of a basic, carbonated calcium sulfonate having a conversion ratio of 1200 and prepared from a 430 molecular weight petroleum sulfonic acid according to the procedure described in U.S. Pat. No. 3,350,308 to 416 parts (1 equivalent) of the acid ester product prepared in Example 4 and 200 parts of mineral oil at 60° C. The reaction mixture is then heated at 110°–120° C. for ½ hour. The residue is the desired product.

EXAMPLE 18

A mixture of 51 parts of the product prepared according to the procedure of Example 10 and 39 parts of Ethomeen C/15 (a product of Armak Co., part of Akzona, Inc.) is heated to 50° C. for 1 hour. The residue is the desired demulsifier product.

EXAMPLE 19

A mixture of 70 parts of the product prepared according to the procedure of Example 11 and 70 parts of Ethoduomeen T/13 (a product of Armak Co.) is heated at 50° C. for 1 hour. The residue is the desired demulsifier product.

EXAMPLE 20

A mixture of 60 parts of the product prepared according to the procedure of Example 16 and 40 parts of Ethomeen C/12 (a product of Armak Co.) is heated at 50° C. for 1 hour. The residue is the desired demulsifier product.

EXAMPLE 20A

A mixture of 120 parts of the product prepared in Example 16B and 60 parts of Ethomeen C/12, and 60 parts of Ethoduomeen T/13 is prepared and heated at 50° C. for 1 hour. The product obtained is the desired demulsifier product.

The fuel compositions of the present invention contain a major proportion of a normally liquid fuel, usually a hydrocarbonaceous petroleum distillate fuel such as motor gasoline as defined by ASTM Specification D-439-73 and diesel fuel or fuel oil as defined by ASTM Specification D-396. Normally liquid fuel compositions comprising nonhydrocarbonaceous materials such as alcohols, ethers, organonitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Normally liquid fuels which are mixtures of one or more hydrocarbonaceous fuels and one or more nonhydrocarbonaceous materials are also contemplated. Examples of such mixtures are combinations of gasoline and ethanol, diesel fuel and ether, etc. Particularly preferred is gasoline, that is, a mixture of hydrocarbons having an ASTM boiling point of about 60° C. at the 10% distillation point to about 205° C. at the 90% distillation point.

Generally, these fuel compositions contain an amount of the demulsifier additive of this invention sufficient to impart the desired demulsifying properties to the fuel; usually this amount is about 1 to about 200 preferably 1 to 40 parts by weight of the reaction product per million parts by weight of fuel. The preferred gasoline-based fuel compositions generally exhibit excellent demulsifying properties.

The fuel compositions of this invention can contain, in addition to the demulsifier of this invention, other additives which are well known to those of skill in the art. These can include antiknock agents such as tetraalkyl lead compounds, lead scavengers such as haloalkanes (e.g., ethylene dichloride and ethylene dibromide), deposite preventors or modifiers such as triaryl phosphates, dyes, cetane improvers, antioxidants such as 2,6-di-tertiarybutyl-4-methylphenol, rust inhibitors such as alkylated succinic acids and anhydrides, bacteriostatic agents, gum inhibitors, metal deactivators, upper cylinder lubricants, anti-icing agents and the like.

In certain preferred fuel compositions of the present invention, the afore-described demulsifier and additives are combined with an ashless dispersant in gasoline. Such ashless dispersants are preferably esters of a mono- or polyol and a high molecular weight mono- or polycarboxylic acid acylating agent containing at least 30 carbon atoms in the acyl moiety. Such esters are well known to those of skill in the art. See, for example, French Pat. No. 1,396,645, British Pat. Nos. 981,850 and 1,055,337 and U.S. Pat. Nos. 3,255,108; 3,311,558; 3,331,776; 3,346,354; 3,522,179; 3,579,450; 3,542,680; 3,381,022; 3,639,242; 3,697,428; 3,708,522; and British Patent Specification No. 1,306,529. These patents are expressly incorporated herein by reference for their disclosure of suitable esters and methods for their preparation. Generally, the weight ratio of the demulsifier of this invention to the aforesaid ashless dispersants is about 0.1 to about 10.0, preferably about 1 to about 10 parts of demulsifier to 1 part ashless dispersant. In still another embodiment of this invention, the inventive additives are combined with Mannich condensation products formed from substituted phenols, aldehydes, polyamines, and substituted pyridines. Such condensation products are described in U.S. Pat. Nos. 3,649,659; 3,558,743; 3,539,633; 3,704,308; and 3,725,277.

As previously indicated, the compositions of this invention are useful as additives for lubricants, in which they function primarily as demulsifier additives. They can be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. They can also be used in gas engines, stationary power engines and turbines and the like. Automatic transmission fluids, transaxle lubricants, gear lubricants, metal-working lubricants, hydraulic fluids and other lubricating oil and grease compositions can also benefit from the incorporation therein of the compositions of the present invention.

Natural oils include animal oils and vegetable oils (e.g., castor oil, lard oil) as well as liquid petroleum oils and solvent-treated or acid-treated mineral lubricating oils of the paraffinic, naphthenic or mixed paraffinic-naphthenic types. Oils of lubricating viscosity derived from coal or shale are also useful base oils. Sythetic lubricating oils include hydrocarbon oils and halo-substituted hydrocarbon oils such as polymerized and interpolymerized olefins [e.g., polybutylenes, polypropylenes, propylene-isobutylene copolymers, chlorinated polybutylenes, poly(1-hexenes), poly(1-octenes), poly(1-decenes), etc. and mixtures thereof]; alkylbenzenes (e.g., dodecylbenzenes, tetradecylbenzenes, dinonylbenzenes, di(2-ethylhexyl)benzenes, etc.); polyphenyls (e.g., biphenyls, terphenyls, alkylated polyphenyls, etc.), alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc. constitute another class of known synthetic lubricating oils. These are exemplified by the oils prepared through polymerization of ethylene oxide or propylene oxide, the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500, etc.) or mono- and polycarboxylic esters thereof, for example, the acetic acid esters, mixed $C_3$–$C_8$ fatty acid esters, or the $C_{13}$ Oxo acid diester of tetraethylene glycol.

Another suitable class of snythetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy)-disiloxane, poly(methyl)siloxanes, poly(methylphenyl)siloxanes, etc.). Other synthetic lubricating oils include liquid esters of phosphorus-containing acids (e.g., tricresyl phosphate, trioctyl phosphate, diethyl ester of decylphosphonic acid, etc.), polymeric tetrahydrofurans and the like.

Unrefined, refined and rerefined oils (and mixtures of each with each other) of the type disclosed hereinabove can be used in the lubricant compositions of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques are known to those of skill in the art such as solvent extraction, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

Generally, the lubricants of the present invention contain an amount of the composition of this invention sufficient to provide it with the desired demulsifying properties. Normally this amount will be about 0.05 to about 2.0%, preferably about 0.1 to about 1.0 of the total weight of the lubricant. In lubricating oils operated under extremely adverse conditions, such as lubricating oils for marine diesel engines, the reaction products of this invention may be present in amounts of up to about 10% by weight.

The demulsifier of this invention can be added directly to the fuel or lubricant to form fuel or lubricant compositions of this invention or they can be diluted with a substantially inert, normally liquid organic solvent/diluent such as mineral oil, xylene, or a normally liquid fuel as described above, to form an additive concentrate which is then added to the fuel or lubricant in sufficient amounts to form the inventive fuel or lubricant composition described herein. These concentrates generally contain up to about 50% by weight, and preferably from about 2 to 30 percent of the demulsifier additive of this invention. Moreover, these concentrates can contain in addition any of the abovedescribed conventional additives, particularly the aforedescribed ashless dispersants in the aforesaid proportions. The remainder of the concentrate is the solvent/diluent.

Lubricating and fuel compositions made according to this invention are exemplified by the following:

EXAMPLE A

The lubricating composition suitable for use as an automatic transmission fluid, is prepared, using as the base oil a mixture of 90% by volume of a 110N mineral oil and 10% by volume of a 200N mineral oil, and as additives, by weight; 4% of a mixed ester of a styrene maleic anhydride copolymer reacted with a nitrogen-containing compound (prepared as in U.S. Pat. No. 3,702,300); 3.0% of a commercially available, proprietary seal swell agent; 1% of the reaction product of a polyisobutenyl-substituted succinic anhydride, commercial tetraethylene pentamine, and boric acid prepared as in U.S. Pat. No. 3,254,025; 0.3% of a commercially available diphenylamine-based oxidation inhibitor; 0.1% of a dialkylphosphite; 0.5% of a conventional friction modifier based on polyoxyethylene tallow amine (Ethomeen T/12); 0.3% of hydroxy thioether as described in U.S. Pat. No. 4,031,023; 3.0% of the reaction product of polyisobutenyl succinic anhydride and ethylene-polyamine; and as the demulsifier 0.2% of the product of Example 10 and 0.05% of Ethomeen C/15.

EXAMPLE B

A lubricating composition suitable for use as an automatic transmission fluid is prepared using an ATF base and, as additives, 0.13% of the reaction product of a dialkylphosphite and an alkyl alpha-olefin epoxide as described in U.S. Pat. No. 3,932,290; 1.75% of the reaction product of a polyisobutenyl succinic anhydride and ethylene polyamine; 0.67% of the reaction product of boric acid with the reaction product of polyisobutenyl succinic anhydride and polyethylene polyamine; 0.52% of a zinc salt of a phosphorodithioic acid; 0.10% of a tallow-substituted diethanol amine; 1.20% of a mixed ester-amide of maleic anhydride-styrene copolymer (12% in solution); 3.00% hydrocarbon resin seal swelling agent; 0.20% substituted diphenylamine; 0.02% of a silicone anti-foam agent; and as the demulsifier 0.25% of the product of Example 15 and 0.09% of Ethomeen C/15.

EXAMPLE C

A lubricating composition suitable for use as a gear lubricant is prepared using an SAE 90 base mineral oil, and as additives: 2.01% of a dialkylphosphite derived from $C_{14-18}$ alcohols; 0.25% of a commercially available aliphatic primary amine, wherein the aliphatic groups are a mixture of tertiary alkyl radicals having 11 to 14 carbon atoms; 0.08% of a conventional anti-foaming agent based upon a polymer of 2-ethylhexyl acrylate and ethyl acrylate; and 4.1% of sulfurized isobutylene; and as a demulsifier 0.7% of the product of Example 11.

EXAMPLE D

A gasoline having a Reed vapor pressure of 8.4 psi and containing 2.0 grams of lead per gallon and as additives: 20 ppm of a Mannich base prepared from tetrapropenyl-substituted phenol, formaldehyde and diethanol amine as in U.S. Pat. No. 3,877,889; 89.6 ppm of the reaction product of polyisobutenyl ($\overline{M}n$ = 1000) succinic anhydride with polyethylene polyamine mixture; 2.9 ppm of an ethoxylated reaction product of oleic-naphthenic acid mixture with polyethylene polyamine mixture; 42 ppm isooctyl alcohol; 118.5 ppm xylene; 3.0 ppm Nalco Proprietary Dehazer Composition; and as the demulsifier 4.0 ppm of the product of Example 20.

EXAMPLE E

A diesel fuel containing 15 parts per million parts of fuel of the product of Example 11.

EXAMPLE F

A lubricating composition suitable for use as a crankcase lubricant is prepared using a 10W-40 mineral lubricating oil base and, as additives: 5.41% of a polyisodecyl acrylate viscosity improver; 4.2% of an ashless dispersant based on the reaction product of a polyisobutenyl ($\overline{M}n$ = 1000) succinic anhydride, pentaerythritol, and polyethylene polyamines; 1.57% of an overbased calcium sulfonate detergent; 0.82% of a zinc salt of a phosphorodithioic acid; 40 ppm of a conventional anti-foam agent; and as a demulsifier 0.25% of the product of Example 17 and 0.05% of Ethoduomeen T/13.

EXAMPLE G

A lubricating composition suitable for use as an industrial gear lubricant is prepared using a SAE 90 base mineral lubricating oil, and as additives: 0.5% of a dialkylphosphite derived from long-chain alcohols; 0.02% of a conventional anti-foaming agent based upon a polymer of 2-ethylhexyl acrylate and ethyl acrylate; 0.25% of a sulfurized isobutylene; and as a demulsifier 0.04% of the product of Example 12 and 0.01% of Ethomeen C/12.

EXAMPLE H

A lubricating composition suitable for use as a marine diesel lubricant is prepared using a SAE 90 base mineral lubricating oil and 5.7% of an additive concentrate. The additive concentrate is mineral oil based and comprises the following additives: 23.44% of the reaction product of a polybutenyl ($\overline{M}n$ = 1000) succinic anhydride, zinc oxide, and ethylene polyamines as in U.S. RE 26,433; 17.05% of a calcium overbased sulfurized alkyl phenol; 1.56% of a zinc salt of a phosphorodithioic acid; 2.87% mineral oil; 8.2% of a slightly basic calcium sulfonate; 46.88% of an overbased calcium sulfonate detergent; and as a demulsifier 0.9% of the product of Example 19.

EXAMPLE I

A lubricating composition suitable for use as a crankcase lubricant is prepared using a 10W-40 mineral lubricating oil base and, as additives: 5.41% of a polyisodecyl acrylate viscosity improver; 4.2% of an ashless dispersant based on the reaction product of a polyisobutenyl ($Mn$ = 1000) succinic anhydride, pentaerythritol, and polyethylene polyamines; 1.57% of an overbased calcium sulfonate detergent; 0.82% of a zinc salt of a phosphorodithioic acid; 40 ppm of a conventional anti-foam agent; and as a demulsifier 0.30% of the product of Example 20A.

To determine the effectiveness of the demulsifier additive in the exemplified lubricants and fuels, the standard method for "Demulsibility Characteristics of Lubricating Oils" as described in ANSI/ASTM D2711-74 is followed. Modification in terms of liquid and/or demulsifier quantities have been made to provide more meaningful data for certain lubricants or fuels. In particular, 200 ml of the test fluid is utilized, which fluid is placed into a blender at room temperature. The blender is operated at low speed for 30 seconds after which 20 mls. of distilled water is added and mixed for one more minute. The mixture is poured into 400 ml. beaker, covered and placed into an oven at 160° ± 2° F. Extent and rate of separation of water and oil, as well as the interface (cuff) is observed at 2 and 4 hour intervals.

In the foregoing examples the lubricants and fuels containing the demulsifier additive have shown excellent demulsifying properties. Automatic transmission fluids containing about 0.1 to about 1% of the demulsifier of the invention can be expected for use in factory filled operations with minimal filtering and centrifuging to remove the included water. Thus, the demulsified fluids provide convenience and economy unavailable heretofore.

What is claimed is:

1. A lubricant composition comprising a major proportion of a lubricating oil and a minor proportion of at least one demulsifier additive comprising the mixture of:

(A) one or more reaction products of a hydrocarbon-substituted succinic acid or anhydride with one or more polyalkylene glycols or mono-ethers thereof, wherein said hydrocarbon substituent is an alkyl or alkenyl radical having from 4 to about 50 carbon atoms, (B) one or more organic basic metal salts, and (C) one or more alkoxylated amines.

2. The lubricant composition of claim 1 wherein the glycol is selected from polyethylene glycol, its mono-ether, and mixtures thereof, and the hydrocarbon substituent on said succinic acid or its anhydride has 6 to about 30 carbon atoms.

3. The lubricant composition of claim 1 wherein the polyalkylene glycol has an average molecular weight of about 200 to about 1500.

4. The lubricant composition of claim 1 wherein the oxyalkylated amine is a tertiary amine having one alkyl group of 12 to 18 carbon atoms, attached to the amino nitrogen.

5. The lubricant composition of claim 3 wherein the glycol is preponderantly polyethylene glycol of about 200 to about 1000 average molecular weight.

6. The lubricant composition of claim 1 wherein the organic basic metal salt is an overbased alkaline earth sulfonate.

7. The lubricant composition of claim 6 wherein the salt is overbased magnesium sulfonate.

8. The lubricant composition of claim 2 wherein the glycol is polyethylene glycol of about 200 to 600 average molecular weight and the hydrocarbon substituent contains about 12 carbon atoms.

9. A lubricant composition comprising a major proportion of a lubricating oil and a minor proportion of at least one demulsifier additive comprising the mixture of:

(A) one or more reaction products of a hydrocarbon-substituted succinic acid or anhydride with one or more polyethylene glycols or mono-ethers thereof, wherein said hydrocarbon substituent is an alkyl or alkenyl radical having 6 to about 30 carbon atoms, (B) one or more organic basic alkaline earth metal salts, and (C) one or more amines characterized by having at least one group of the formula $—NR_1R_2$ wherein $R_1$ is $\text{-}(\text{O-alkylene})_n\text{OH}$ wherein alkylene contains up to 6 carbon atoms, and n is a number of 1 to about 10, $R_2$ is selected from hydrogen, alkyl of up to about 18 carbon atoms, and $R_1$.

10. The lubricant composition of claim 9 wherein the hydrocarbon substituent on said succinic acid or anhydride has about 8 to about 16 carbon atoms.

11. The lubricant composition of claim 9 wherein (A) represents the reaction product of a dodecyl-succinic acid or anhydride with a polyethylene glycol of about 300 average molecular weight, and (C) represents a tertiary amine $RNR_1R_2$ wherein R is an alkyl of up to about 18 carbon atoms, and the number n for the $\text{-}(\text{O-alkylene})_n\text{OH}$ in $R_1$ is from to to 8.

12. The lubricant composition of claim 11 in which the tertiary amine has $R_2$ the same as $R_1$ with n being 2 to 4, and wherein R is an alkyl group of about 12 to 18 carbon atoms.

13. The lubricant composition of claim 11 wherein the organic basic metal salt is overbased magnesium sulfonate.

14. In an automatic transmission fluid having a major proportion of lubricating oil and minor proportion of one or more additives including seal swellers, viscosity modifiers, dispersants, detergents, extreme pressure agents and anti-wear agents, anti-rust agents and corrosion inhibitors, the improvement which comprises incorporating into said fluid at least one demulsifier additive comprising the mixture of:

(A) one or more reaction products of a hydrocarbon-substituted succinic acid or anhydride with one or more polyalkylene glycols or mono-ethers thereof, wherein the hydrocarbon substituent on said acid or anhydride is an alkyl or alkenyl radical having about 6 to about 30 carbon atoms, and said polyalkylene glycols have an average molecular weight of about 200 to 1500, (B) one or more organic basic alkaline earth metal salts, and (C) one or more amines characterized by having at least one group of the formula $—NR_1R_2$ wherein $R_1$ is $\text{-}(\text{O-alkylene})_n\text{OH}$ wherein alkylene contains up to 6 carbon atoms, and n is a number of 1 to about 10, and $R_2$ is selected from hydrogen, alkyl of up to about 18 carbon atoms, and $R_1$.

15. The improvement of claim 14 wherein the hydrocarbon substituent on the succinic acid or anhydride has about 8 to 16 carbon atoms and the glycol is a polyethylene glycol of an average molecular weight of 200 to 600.

16. The improvement of claim 15 wherein the substituent on said succinic acid or anhydride is dodecyl radical.

17. The automatic transmission fluid of claim 16 wherein the organic basic salt is an overbased magnesium sulfonate.

18. The automatic transmission fluid of claim 17 wherein said amine is a tertiary amine $RNR_1R_2$ with R representing an alkyl group of up to 18 carbon atoms.

19. The automatic transmission of claim 18 wherein the amine has $R_2$ the same as $R_1$ with n being 2 to 4 and R an alkyl group of about 12 to 18 carbon atoms.

20. A concentrate suitable for imparting demulsifying properties to normally liquid fuels and lubricating compositions which comprises a normally liquid, substantially inert diluent, and from about 2 to about 50% by weight of at least one additive comprising the mixture of:

(A) one or more reaction products of a hydrocarbon-substituted succinic acid or anhydride with one or more polyalkylene glycols or mono-ethers thereof, wherein said hydrocarbon substituent is an alkyl or alkenyl radical having from 4 to about 50 carbon atoms, (B) one or more organic basic metal salts, and (C) one or more alkoxylated amines.

21. A method of preparing a demulsified normally liquid fuel or lubricant composition having a major proportion of a normally liquid fuel or lubricating oil, which comprises incorporating into said fuel or lubricating oil a minor proportion of at least one additive comprising the mixture of:

(A) one or more reaction products of a hydrocarbon-substituted succinic acid or anhydride with one or more polyalkylene glycols or mono-ethers thereof, wherein said hydrocarbon substituent is an alkyl or alkenyl radical having from 4 to about 50 carbon atoms, (B) one or more organic basic metal salts, and (C) one or more alkoxylated amines.

22. The concentrate of claim 20 wherein the demulsifier additive constitutes up to about 30% by weight of said concentrate.

23. The concentrate of claim 22 wherein the hydrocarbon substituent in component (A) has 6 to about 30 carbon atoms.

24. The concentrate of claim 22 wherein the metal salt in component (B) is substantially an alkaline earth metal salt.

25. The concentrate of claim 22 wherein the alkoxylated amine is selected from the group consisting of ethoxylated and propoxylated tertiary and secondary amines.

26. The concentrate of claim 23 wherein the hydrocarbon substituent in (A) has from 8 to 16 carbon atoms and the basic metal salt in (B) is an alkaline earth metal salt.

27. The concentrate of claim 26 wherein the alkoxylated amine has at least one group of the formula $-NR_1R_2$ wherein $R_1$ is $\text{-}(\text{O-alkylene})_n\text{OH}$ in which alkylene contains up to 6 carbon atoms, and n is a number of 1 to about 10, and $R_2$ is selected from hydrogen, alkyl of up to 18 carbon atoms, and $R_1$.

28. The concentrate of claim 27 wherein the alkoxylated amine is a tertiary amine having from 2 to 15 (O alkylene) units.

29. The concentrate of claim 27 wherein the hydrocarbon substituent in (A) is a dodecyl group, the salt in (B) is a magnesium salt, and the alkoxylated amine is an ethoxylated tertiary amine having 5 ethoxy groups.

30. The method of claim 21 in which component (A) and (B) are admixed first and heated at about 50°-125° C. for up to 3 hours.

31. The method of claim 30 wherein (A) is the reaction product of hydrocarbon-substituted succinic anhydride with polyoxyethylene glycol having an average molecular weight of about 200 to about 600, and (B) is a basic alkaline earth metal salt.

32. The method of claim 31 wherein the hydrocarbon substituent of (A) has from 6 to about 30 carbons and the alkoxylated amine of (C) is a tertiary amine.

33. A fuel composition having demulsified properties resulting from the incorporation of 1 to 200 parts per million based on the fuel of a demulsifier additive comprising the mixture of:

(A) one or more reaction products of a hydrocarbon-substituted succinic acid or anhydride with one or more polyalkylene glycols or mono-ethers thereof, wherein said hydrocarbon substituent is an alkyl or alkenyl radical having from 4 to about 50 carbon atoms, (B) one or more organic basic metal salts, and (C) one or more alkoxylated amines.

* * * * *